US007311060B1

(12) United States Patent
Giblin et al.

(10) Patent No.: US 7,311,060 B1
(45) Date of Patent: Dec. 25, 2007

(54) SOFT SHELTER EXTENSIONS FOR RECREATIONAL VEHICLES AND THE LIKE

(75) Inventors: James Giblin, Seattle, WA (US); Thomas Gruber, Seattle, WA (US); James Marson, Seattle, WA (US); Doug Jacot, Kingston, WA (US); Terry Breaux, Seattle, WA (US)

(73) Assignee: Cascade Designs, Inc., Seattle, WA (US)

( * ) Notice: Subject to any disclaimer, the term of this patent is extended or adjusted under 35 U.S.C. 154(b) by 0 days.

(21) Appl. No.: 11/519,439

(22) Filed: Sep. 11, 2006

Related U.S. Application Data

(60) Provisional application No. 60/715,549, filed on Sep. 8, 2005.

(51) Int. Cl.
*B63B 17/00* (2006.01)

(52) U.S. Cl. ..... 114/361; 135/68.01; 296/110

(58) Field of Classification Search ..... 114/343, 114/351, 361, 364; 135/88.01, 88.02, 88.09, 135/88.13; 160/122; 296/110
See application file for complete search history.

(56) References Cited

U.S. PATENT DOCUMENTS 1,854,377 A * 4/1932 Mahr ..... 296/110
1,919,603 A * 7/1933 Stinson ..... 296/110
2,628,862 A * 2/1953 Packman ..... 296/110
2,634,162 A * 4/1953 Beynon ..... 296/110
2,689,579 A * 9/1954 Sartori ..... 135/133
3,161,231 A * 12/1964 Dawson et al. ..... 135/132
4,402,544 A * 9/1983 Artim et al. ..... 296/110
6,216,714 B1 * 4/2001 Tucker ..... 135/88.01

* cited by examiner

*Primary Examiner*—Lars A. Olson
(74) *Attorney, Agent, or Firm*—Graybeal Jackson Haley LLP

(57) ABSTRACT

Embodiments of the invention are directed to a soft shelter extension for use with a hard shelter where the hard shelter has a perimeter opening defined by a side wall and sealable by a deck rotationally coupled thereto, wherein the deck is prevented from over rotating by a pair of opposing cables linking the side wall to the deck. Such embodiments include a bow assembly having a plurality of bows wherein first ends are linkable to each other and second ends are linkable to each other, either directly or indirectly. These embodiments further include a pair of cable slide interfaces linked to respective first and second ends of the plurality of bows to receive the respective pair of cables. A flexible panel covers the bow assembly, and mates to the side wall and to the deck to form an enclosed space when the deck is rotated to a position wherein the cables are in tension.

20 Claims, 4 Drawing Sheets

SOFT SHELTER EXTENSIONS FOR RECREATIONAL VEHICLES AND THE LIKE

CROSS-REFERENCE TO RELATED APPLICATION

This is a continuation-in-part application that claims benefit, under 35 USC §119(e), of U.S. Provisional Application 60/715,549, filed on 8 Sep. 2005, which is incorporated herein by reference.

BACKGROUND OF THE INVENTION

Hard shelters provide occupants with desirable insulation from the outside environment, but such protection comes with a price. Hard shelters are generally rigid, making transportation difficult, are expensive to manufacture, are heavy to transport, and are difficult to augment. In the field of transportable hard shelters for recreational purposes, there are generally three common types: self-propelled recreational vehicles (RVs); self-contained campers (slide-in/slide-out for use with pickup trucks); and towed trailers.

Government restrictions on the size of vehicles generally limits a vehicle's width to 8 feet or less, unless special permits are obtained. Moreover, practical limits associated with access roads and the like effectively limit the width of RVs, campers and trailers. Therefore, until recently enthusiasts were limited to hard shelters having a width no greater than 8 feet. As intimated above, however, the configuration necessary for travel on the roads is not mandated for times wherein the RV, camper or trailer is at rest. "Slide outs" have become popular options for many RVs and some campers. Slide outs take advantage of the fact that the width dimension can be increased when the RV or camper is at rest. Slide outs have rigid extension walls (upper, lower, front, rear and side) in addition to suitable operational hardware.

While slide outs advantageously increase the interior volume of the hard shelter, they do so at the expense of economy, simplicity and weight. For large Class A RVs, which can cost in excess of $100,000, economy, simplicity and weight considerations are minimal. However, where such considerations are important, slide outs may not be a viable option. Therefore, a need exists to create an interior volume enhancing extension that is simple, inexpensive when compared to rigid slide outs, and light in weight so that non-specialized vehicles can carry/tow them.

SUMMARY OF THE INVENTION

The invention is directed to soft shelter extensions from hard shelters, such as vehicles, campers and trailers. The hard shelters are characterized as having a side wall defining an opening, preferably sealable by a substantially rigid and horizontally hinged deck, which operates as a side wall portion when in the vertical position. The soft shelters of the invention comprise a flexible outer covering that operates to define a partially enclosed volume, and substantially rigid supporting infrastructure that operates to provide a frame in order to maintain the desired shape and volume of the shelter.

Preferably, the soft shelter extension is externally mounted to the hard shelter for enhanced interior weather resistance, with minimal to no intrusion into the interior space of the hard shelter, and expands to a generally functional state upon opening of the hinged deck.

The invention comprises apparatus, systems and methods for creating soft shelter extensions. For context purposes only, embodiments of the invention engage with both a substantially vertical portion or side wall of a hard shelter, and a horizontally pivoting member or deck that forms a part of the vertical portion or side wall of the hard shelter when not in use. Apparatus embodiments of the invention comprise a supporting infrastructure and a flexible covering. The supporting infrastructure in turn comprises a plurality of hoops or bows, each having a first end and a second end, wherein the first ends are linkable to each other, either directly or indirectly, and the second ends are linkable to each other, either directly or indirectly. Each bow or hoop approximates an arch (substantially curvilinear, rectilinear or a combination of the two), and operates to establish a volume in conjunction with the flexible covering, which is preferably robustly associated therewith to minimize differential movement between the two components.

Unlike bow systems of the prior art which rigidly link the bows to one of the side wall or the deck, embodiments of the invention preferably use a floating bow assembly that is not rigidly linked to the hard shelter but is nevertheless continuously linked to the side wall and to the deck. This arrangement advantageously permits gravity to cause the bows to depend into the volume defined by the perimeter of the opening in the side wall during stowage, and therefore avoid interference with the operation of the deck. To establish requisite rigidity, removable struts are used to link the bows to the hard shelter. In certain preferred embodiments, the struts are lever struts, which permit a user to engage the strut with the bow(s) and the hard shelter, and then axially extend the strut to impart the desired degree of stiffness to the assembly.

A consequence to using a floating bow arrangement is that during expansion of the soft shelter extension, the weight of the bow arrangement requires a user to prop up the same before engaging the struts. A feature of select embodiments of the invention employing a floating bow assembly provides for a deployment assistance means that causes the bows to distend from the hard shelter as the deck is rotated from the hard shelter and prior to engagement with the struts. The deployment assistance means in certain embodiments comprises a pair of tension members linking the side wall of the hard shelter to the deck. When first ends of such tension members are linked at opposing sides of the side wall perimeter and second ends linked opposing sides of the deck, and when the bow assembly is slidingly engaged therewith, the bow assembly is caused to elevate away from the deck when the tension members are brought into tension. Beneficially, the tension members, which are preferably cables, also function to arrest over-rotation of the deck in the event of failure of the soft shelter flexible panel. In addition, the tension members may also function to restrain complete collapse of the bow members towards the deck when the deck is in the stowed position.

The apparatus embodiments further comprise at least one flexible panel of material that substantially forms fitted sections of material between the bows or hoops when the shelter is in an expanded or deployed state, as is convention in the art. The at least one flexible panel may be linked to the plurality of bows or hoops, which is preferable, or may be fitted over the bows or hoops. In addition, the at least one panel includes a hard shelter engaging portion and a deck engaging portion. The hard shelter engaging portion preferably interfaces with the hard shelter side wall or perimeter thereof defining the opening therein. In so doing, a generally sealing arrangement is created between the perimeter defining the opening and the soft shelter. In a series of preferred embodiments, this sealing arrangement, which uses a "J"

track at least at an upper perimeter of the opening, takes place at three of the four sides of a conventional four-sided rectilinear opening. The deck engaging portion preferably interfaces with an inner perimeter portion of the deck, and includes a skirt that shields the interface from exposure to the elements. Thus, when fully interfaced with the hard shelter and the deck, and in the deployed state, an enclosed structure is created that has a primary inner opening positioned at the opening defined by the side wall of the hard shelter.

System embodiments of the invention comprise the apparatus and the hard shelter. Thus, in addition to the plurality of bows or hoops and the at least one flexible panel, systems comprise a hard shelter having at least one sidewall defining an opening, and a deck horizontally hinged to a lower portion of the opening such that when in a closed position, the deck is generally coplanar to the sidewall (a depth difference between the deck and the sidewall of up to several inches is considered to be a generally coplanar arrangement), and when in a deployed position with the apparatus operatively engaged with the hard shelter, the deck is generally orthogonal to the sidewall.

DETAILED DESCRIPTION OF AN EMBODIMENT OF THE INVENTION

Figure 1:
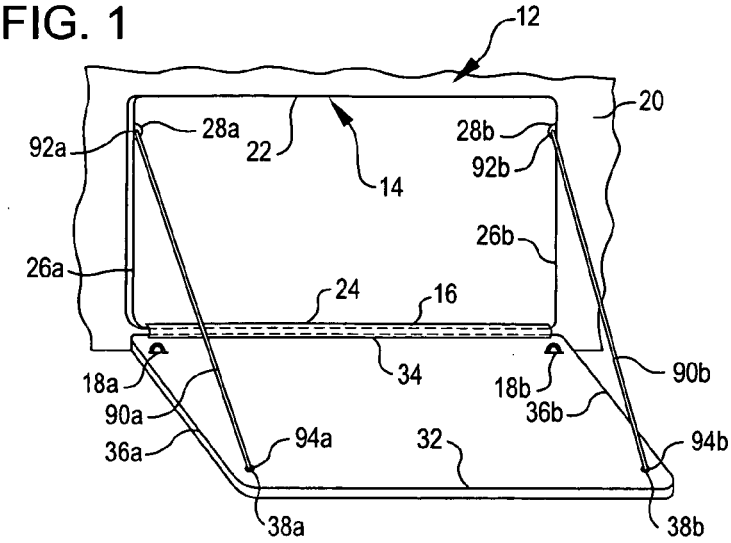
FIG. 1 is a perspective view of a hard shelter side wall having an opening defined by a perimeter and a deck shown in a rotated position, and suspended by a pair of cables.
Figure 2:
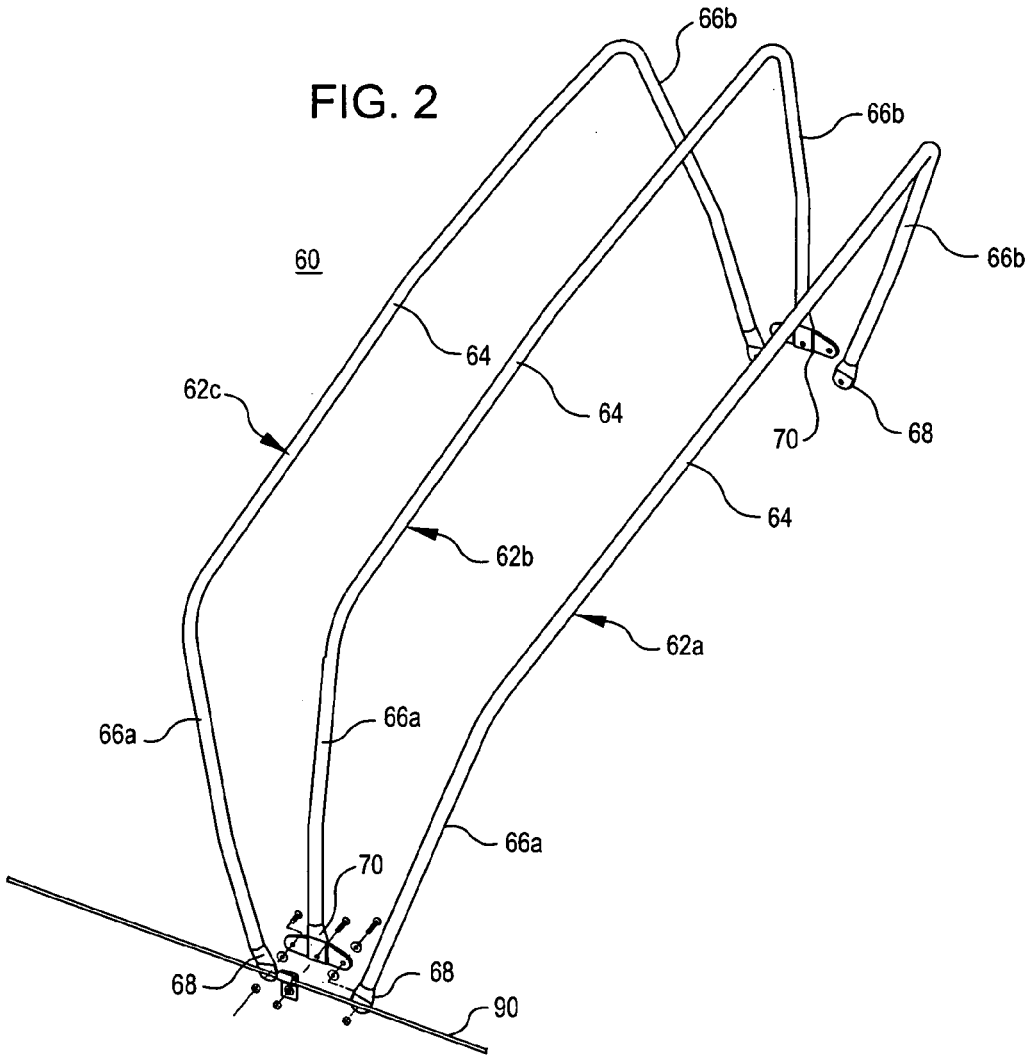
FIG. 2 is an exploded perspective view of a bow assembly.

Turning then to the several Figures, wherein like numbers reference like parts, soft shelter 10 and its association with hard shelter 12 are shown. Soft shelter 10 generally comprises bow assembly 60, which includes bows 62*a-c*, and flexible panel 150, while hard shelter 12 generally comprises side wall 20 and deck 30. Bow assembly 60 and components related to providing structural integrity to soft shelter 10 are preferably constructed from a suitable rigid material such as a metal (galvanized steel or aluminum being preferred) or composite (fiberglass or carbon fiber composites being preferred), while flexible panel 150 is preferably constructed from a coated polyester or similar fabric material having substantial fluid impervious characteristics. Both side wall 20 and deck 30 are constructed from materials conventionally used in hard shelters found in RVs, including wood framing with metal or fiberglass skins.

Sidewall 20 defines perimeter opening 14, which includes upper perimeter portion 22, lower perimeter portion 24 and lateral perimeter portions 26*a* and 26*b*. At or adjacent to lower perimeter portion 24 is hinge 16, which functions to rotationally link deck 30 to side wall 20. Deck 30, which in the stowed position functions to sealingly close perimeter opening 14, includes upper or distal perimeter portion 32, lower or proximal perimeter portion 34 and lateral perimeter portions 36*a* and 36*b*. While a variety of over-rotation prevention means may be used, the illustrated embodiment uses cables 90*a* and 90*b* linked to attachment points 28*a* and 38*a*, and 28*b* and 38*b*, respectively as shown. As will be shown in greater detail below, these cables both provide suitable support for deck 30 as well as provide extension assistance to bow assembly 60.

Figure 3:
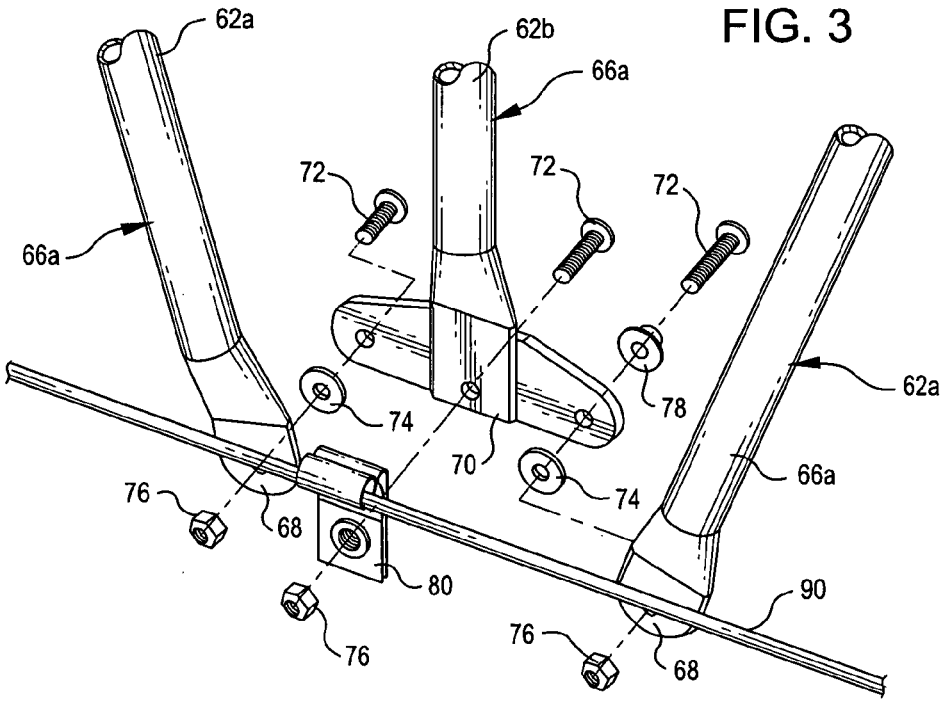
FIG. 3 is a detailed exploded perspective view of the bow assembly shown in FIG. 2.

Turning then to bow assembly 60 as best shown in FIGS. 2-5, this component of the illustrated embodiment includes bows 62*a*, 62*b* and 62*c*, each of which includes respective horizontal support portions 64 and strut portions 66*a* and 66*b*. Bows 62*a* and 62*c* are shown having singular flange attachment ends 68, while bow 62*b* is shown having multi-point attachment flange 70, which provides connection points for attachment ends 68 as best shown in FIG. 3. Linkage of bows 62*a-c* via attachment flange 70 is preferably carried out by bolts 72, washers 74 and nuts 76. Collar 78 is preferably included to provide a means for connecting lever struts 100*a* and 100*b* to bow assembly 60, as will be described in more detail below.

Lastly, a rigid deployment is considered desirable. To this end, lever struts 100*a* (not shown) and 100*b* (shown in FIGS. 6-8) are used to link bow assembly 60 to deck 30. Each strut 100 comprises tube 102, which has ends 104 and 106. Ball catch hole 108 is formed therein to permit ball catch 116 to partially extend there through. Also defined by tube 102 is pivot hole 110. At end 106, internal threaded member assembly 112 receives threaded eye bolt 114. Eye bolt 114 provides the principle means for adjusting the effective range and operating length of lever strut 100. It also permits convenient swiveling about deck 30 through its interface with pad eye 18, which allows it to be advantageously attached to deck 30 when not in use (see FIG. 5).

Figure 7:
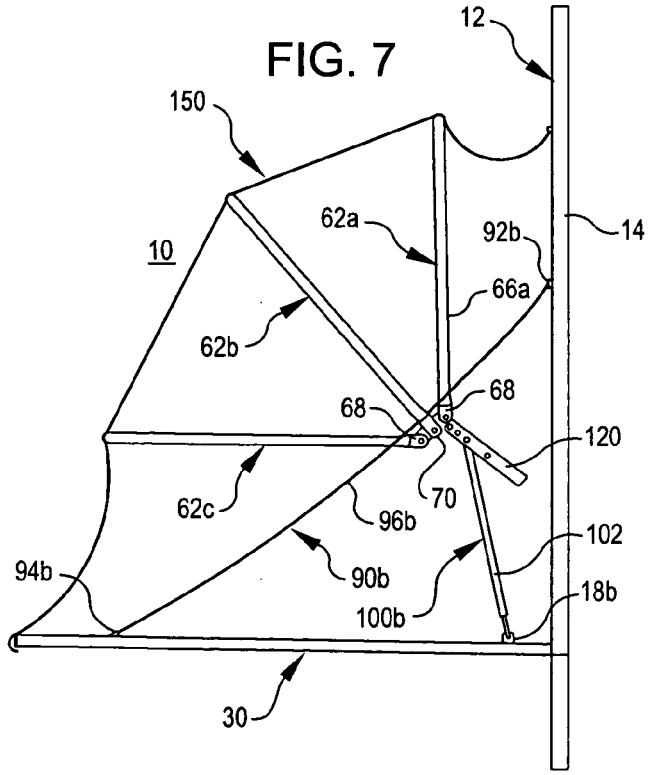
FIG. 7 is a schematic side elevation of the soft shelter extension of FIG. 6 shown in a generally deployed state.
Figure 4:
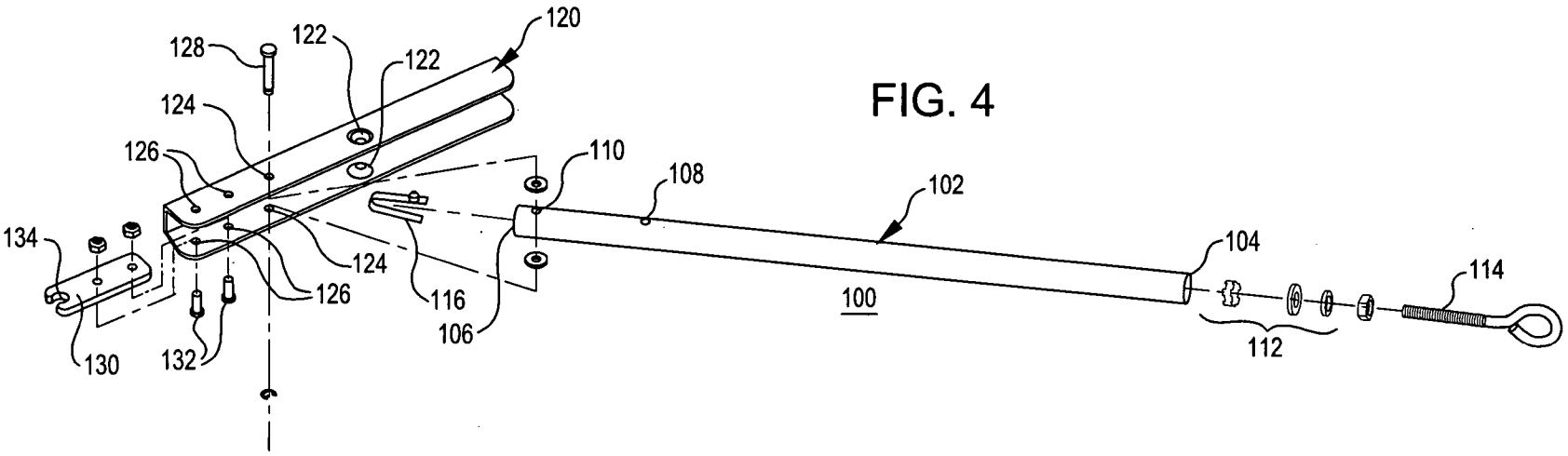
FIG. 4 is an exploded perspective view of a lever strut used to position and retain the bow assembly in an expanded state.
Figure 5:
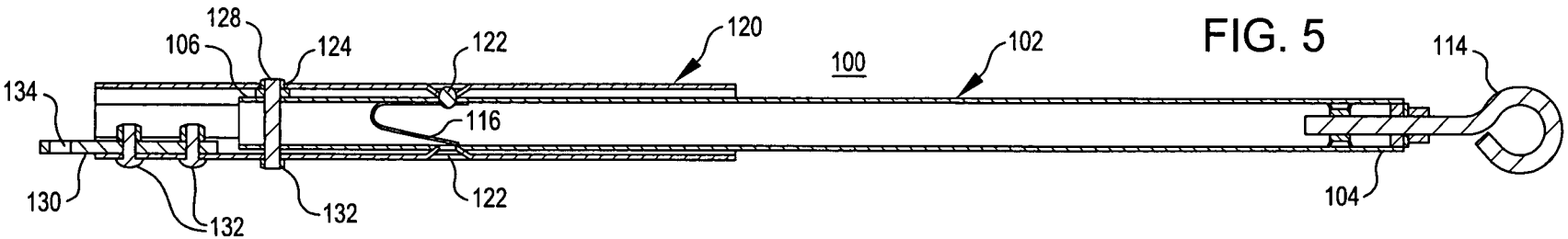
FIG. 5 is an assembled cross section of the strut shown in FIG. 4.

To facilitate the user's ability to impart sufficient extension of bow assembly 60, a compounding lever arrangement is used as shown in FIG. 7. As shown in FIGS. 4 and 5, channel lever 120 is pivotally attached to tube 102 via pivot holes 124 and clevis pin assembly 128. Ball catch holes 122 operatively receive partially protruding ball catch 116 when channel lever 120 is in the locked position. Fork member 130, which is attached to channel lever 120 via fasteners 132, engages collar 78.

As previously touched upon, bow assembly 60 is preferably linked to cables 90*a* and 90*b*. The linkage is a sliding one, which permits bow assembly 60 to self-position during deployment while still being subject to the bias provided by cables 90*a* and 90*b*. To accomplish this desired linkage, slide guides 80 are linked to respective attachment flanges 70, and cables 90*a* and 90*b* passed there through, as shown best in FIG. 3 with respect to a generic arrangement.

Figure 6:
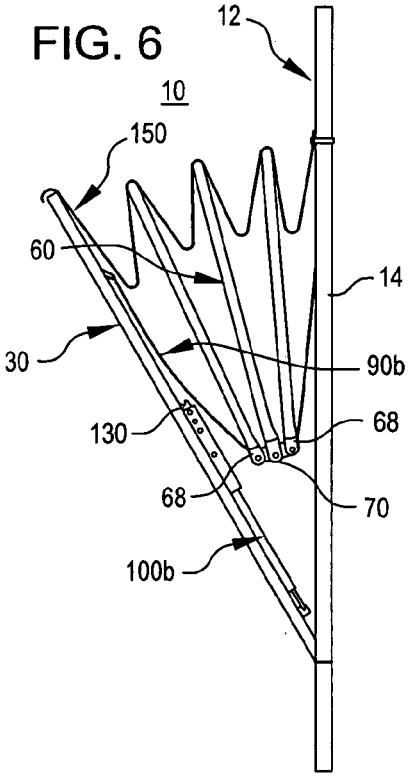
FIG. 6 is a schematic side elevation of a soft shelter extension according to the invention in a generally collapsed state.
Figure 8:
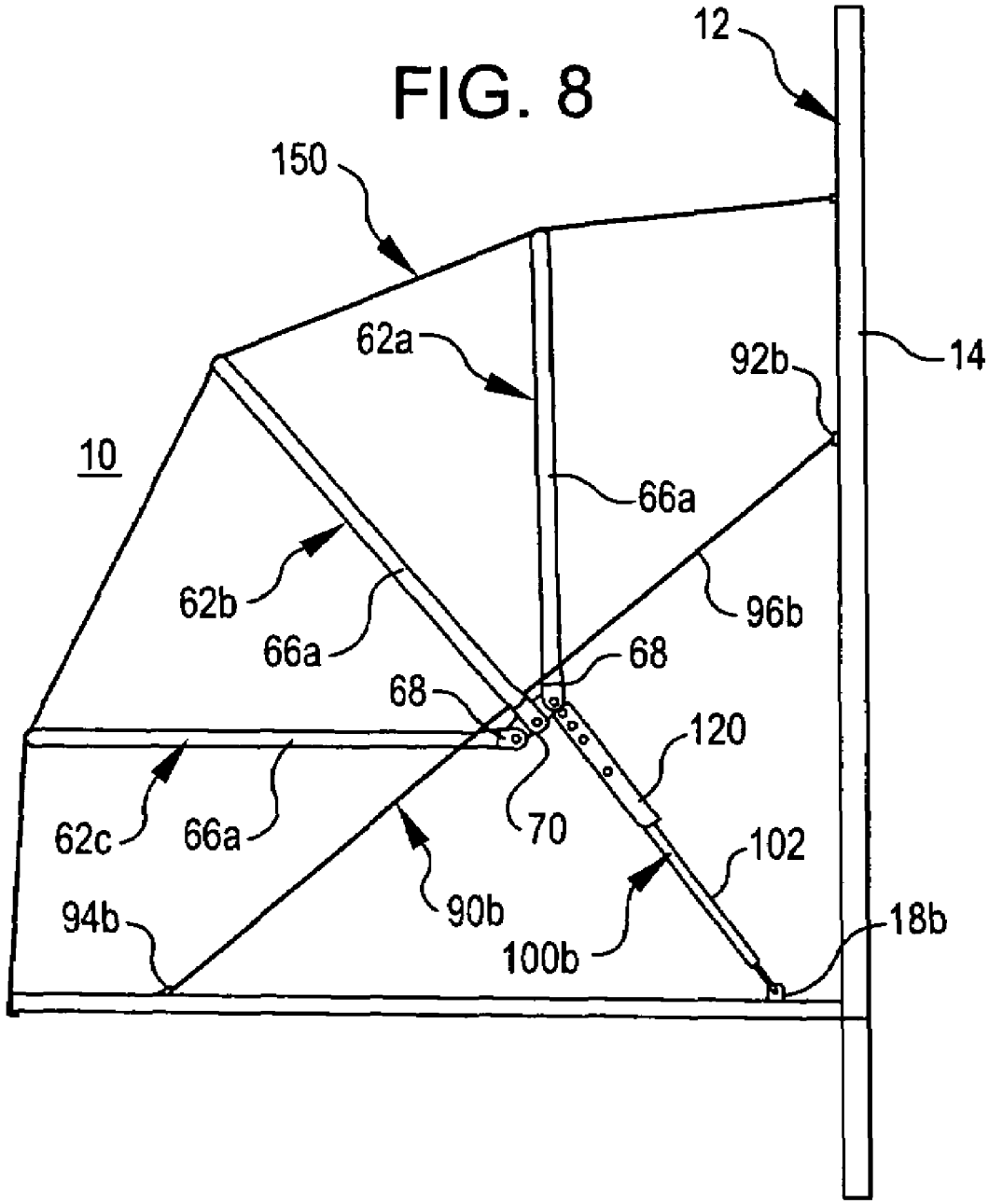
FIG. 8 is a schematic side elevation of the soft shelter extension of FIG. 6 shown in a fully deployed and locked state.

To fully appreciate the operation of the illustrated embodiment, reference is made to FIGS. 6-8. In the substantially stowed state shown in FIG. 6, cable 90*b* provides support for bow assembly 60 to prevent the same (as well as flexible panel 150) from depending unnecessarily into the interior of the hard shelter. Upon further rotation of deck 30, tension is imparted to cable 90*b*, which ultimately prevents over rotation of deck 30 and causes bow assembly 60 to assume a nearly deployed state as shown in FIG. 7. At this time, lever strut 100*b* is removed from its stowed position (see FIG. 6) and fork member 130 is linked to attachment flange 70, and particularly to collar 78*a*. Pivoting of channel lever 120 as shown by the arrow causes the strut to achieve a pre-established length, which in turn fully deploys soft shelter 10 as shown in FIG. 8.

In addition to the advantages provided by bow assembly 60 and it's interface with hard shelter 12, several aspects of flexible panel 150 merit discussion. Moisture and particularly liquid water intrusion into the interior of the hard shelter is of primary concern when a soft shelter is extended there from. A primary location for such intrusion is the interface between the soft shelter and the hard shelter. To mitigate this locus of intrusion, embodiments of the invention provide for a "J" track at least at upper perimeter 22 of side wall 20. Through this arrangement, an effective water tight seal is created that also permits installation and removal of panel 150 with relative ease. Thus, both manufacturing and assembly costs are reduced, as well as repair and/or replacement costs.

What is claimed:

1. A soft shelter extension for use with a hard shelter having a perimeter formed by a side wall and defining an opening sealable by a deck rotationally linked thereto, wherein the deck is prevented from over rotating by first and second cables linking the side wall to the deck, the extension comprising:

a bow assembly having a plurality of bows, each bow including a first end and a second end, wherein the first ends are linkable to each other, either directly or indirectly, and the second ends are linkable to each other, either directly or indirectly;

first and second cable slide interfaces linked to respective first and second ends of at least one of the plurality of bows to receive the respective pair of cables; and a flexible panel to cover the bow assembly, and matable to the side wall and to the deck to form an enclosed space when the deck is rotated to a deployed position.

2. The soft shelter extension of claim 1 wherein the bow assembly is supported by the first and second cables during deployment of the extension.

3. The soft shelter extension of claim 1 further comprising first and second struts linkable at first ends to respective first and second ends of the plurality of bows, and linkable at second ends to the deck.

4. The soft shelter extension of claim 3 wherein the first and second struts comprise a macro extension feature at one end thereof to selectively increase the struts' effective length upon deployment of the extension and to resist unintentional retraction of the struts when so extended.

5. The soft shelter extension of claim 4 wherein the macro extension feature comprises a lever having a first end, a second end, and a body portion, and wherein the first end of each lever is attachable to at least one of the plurality of bows, the body portion is linkable to one end of a strut and the second end operates as a lever arm.

6. The soft shelter extension of claim 3 wherein each strut detachably connects to one end of the bow assembly.

7. The soft shelter extension of claim 6, wherein each strut is disconnected from one end of the bow assembly during stowage of the extension.

8. The soft shelter extension of claim 3 wherein each strut comprises a micro length adjustment feature that modifies the static length of the strut.

9. The soft shelter extension of claim 8 wherein the micro length adjustment feature comprises a screw jack length adjustment arrangement.

10. The soft shelter extension of claim 1 wherein at least some of the bows are secured to the flexible panel.

11. A hard shelter with a soft shelter extension combination comprising:

a perimeter formed by a side wall of the hard shelter and defining an opening a deck rotationally linked to the side wall;

first and second cables linking the side wall to the deck to prevent over-rotation of the deck relative to the side wall during deployment of the soft shelter;

a bow assembly having a plurality of bows, each bow including a first end and a second end, wherein the first ends are linkable to each other, either directly or indirectly, and the second ends are linkable to each other, either directly or indirectly;

first and second cable slide interfaces linked to respective first and second ends of at least one of the plurality of bows to receive the respective pair of cables; and a flexible panel to cover the bow assembly, and matable to the side wall and to the deck to form a soft shelter enclosed space when the deck is rotated to a deployed position.

12. The combination of claim 11 wherein the bow assembly is supported by the first and second cables during deployment of the extension.

13. The combination of claim 11 further comprising first and second struts linkable at first ends to respective first and second ends of the plurality of bows, and linkable at second ends to the deck.

14. The combination of claim 13 wherein the first and second struts comprise a macro extension feature at one end thereof to selectively increase the struts' effective length upon deployment of the extension and to resist unintentional retraction of the struts when so extended.

15. The combination of claim 14 wherein the macro extension feature comprises a lever having a first end, a second end, and a body portion, and wherein the first end of each lever is attachable to at least one of the plurality of bows, the body portion is linkable to one end of a strut and the second end operates as a lever arm.

16. The combination of claim 13 wherein each strut detachably connects to one end of the bow assembly.

17. The combination of claim 16, wherein each strut is disconnected from one end of the bow assembly during stowage of the extension.

18. The combination of claim 13 wherein each strut comprises a micro length adjustment feature that modifies the static length of the strut.

19. The combination of claim 18 wherein the micro length adjustment feature comprises a screw jack length adjustment arrangement.

20. The combination of claim 11 wherein at least some of the bows are secured to the flexible panel.

* * * * *

UNITED STATES PATENT AND TRADEMARK OFFICE

CERTIFICATE OF CORRECTION

PATENT NO. : 7,311,060 B1
APPLICATION NO. : 11/519439
DATED : December 25, 2007
INVENTOR(S) : Thomas Gruber It is certified that error appears in the above-identified patent and that said Letters Patent is hereby corrected as shown below:

Title Page, Under Item (12) delete "Giblin et al." insert --Gruber--

Title Page, Item (75) delete named inventors "James Giblin, James Marson, Doug Jacot, Terry Breaux"

Title Page, Item (75) insert Inventor: --Thomas Gruber, Seattle, WA (USA)--

Signed and Sealed this

Twenty-fourth Day of March, 2009

JOHN DOLL
*Acting Director of the United States Patent and Trademark Office*